US008616938B1

(12) United States Patent
Mills

(10) Patent No.: US 8,616,938 B1
(45) Date of Patent: Dec. 31, 2013

(54) HAND-HELD BLADE SHARPENER

(76) Inventor: Mark S. Mills, Erie, PA (US)

( * ) Notice: Subject to any disclaimer, the term of this patent is extended or adjusted under 35 U.S.C. 154(b) by 419 days.

(21) Appl. No.: 13/135,272

(22) Filed: Jun. 29, 2011

(51) Int. Cl.
*B24B 9/00* (2006.01)

(52) U.S. Cl.
USPC ..... 451/349; 451/419; 451/439; 451/545

(58) Field of Classification Search
USPC ..... 451/349, 419, 439, 545
See application file for complete search history.

(56) References Cited

U.S. PATENT DOCUMENTS

| | | | | | |
|---|---|---|---|---|---|
| 1,961,328 | A * | 6/1934 | Beach | 451/241 |
| 2,092,443 | A * | 9/1937 | Crossley | 451/486 |
| 2,603,919 | A * | 7/1952 | Robinson | 451/353 |
| 3,212,541 | A * | 10/1965 | Burrows et al. | 144/134.1 |
| 3,745,718 | A * | 7/1973 | Peebles | 451/439 |
| 4,566,511 | A * | 1/1986 | Robinson | 144/48.6 |
| 4,788,797 | A * | 12/1988 | Kane et al. | 451/344 |
| 4,934,108 | A * | 6/1990 | Hall | 451/358 |
| 5,136,816 | A * | 8/1992 | Beckingham | 451/282 |
| 5,159,784 | A * | 11/1992 | Varner et al. | 451/349 |
| 6,257,967 | B1 * | 7/2001 | Schultz | 451/349 |
| 6,702,656 | B1 * | 3/2004 | Hibbert | 451/120 |
| 6,846,231 | B2 * | 1/2005 | Oles et al. | 451/415 |
| 7,281,969 | B2 * | 10/2007 | Naples et al. | 451/371 |
| 2003/0166386 | A1 * | 9/2003 | McDonald | 451/360 |

* cited by examiner

*Primary Examiner* — Lee D Wilson
*Assistant Examiner* — Tyrone V Hall, Jr.
(74) *Attorney, Agent, or Firm* — Richard R Thomson

(57) ABSTRACT

A battery-powered, hand-held blade sharpener features a self-adjusting set of guide rollers which widen to accommodate the thickness of the blade being sharpened. First and second semi-circular face plates mount sets of guide rollers, one of the face plates is mounted for pivotal movement and sprig-biased to a "closed jaw" position which the thickness of the blade opens as necessary.

11 Claims, 3 Drawing Sheets

HAND-HELD BLADE SHARPENER

BACKGROUND AND SUMMARY OF THE INVENTION

The present invention is directed to the field of harvesting. More particularly, the present invention is directed to a hand-held blade sharpener which permits in situ sharpening of blades on wood chippers, forage harvesters, and the like.

Currently, to sharpen blades on equipment used in textiles, lumber manufacturing, OSB board manufacturing and the farming industry, such as fiber processors, chippers, and forage harvesters of various sorts, the blades must be removed from the machine and sharpened in a tabletop-style sharpener. Such disassembly, reassembly obviously is time consuming driving up the cost. Further, the tabletop style sharpeners are themselves quite expensive. Lastly, reducing the handling of particularly the sharpened blades will also reduce the risk of injury to the blade mechanic.

The present invention provides a hand-held sharpener which can sharpen the blades in situ, such that the blades need not be removed, saving significant time, restoring the cutting machine to operating condition more quickly and economically. It is preferred that the hand-held sharpener of the present invention be utilized to back grind the blade so as not to reduce the feed angle on those machines, such as chippers, for example, which rely on the blades to feed the product through the machine.

The hand-held sharpener of the present invention features a) a rotary power tool including i) a handle having an opening extending there through; ii) a body having securement means for receiving attachments, the securement means defining a first longitudinal axis; b) a nose piece threadably attachable to the body through the opening in said handle, the nose piece having i) a first set of guide rollers affixed thereto at a first angle relative to the first longitudinal axis; ii) a second set of guide rollers mounted at a second different angle relative to the first longitudinal axis; whereby the first and second sets of guide rollers engage opposing faces of a blade to be sharpened. Preferably, the second set of guide rollers is secured to a second face plate, the second face plate being mounted to said nose piece in a manner to permit limited pivotal movement relative to the first longitudinal axis making the hand-held blade sharpener self-adjusting.

The second face plate is a semi-circular member and a first one of the second set of guide rollers is mounted on a first side of the first longitudinal axis and a second one of the second set of guide rollers is mounted on a second opposite side of the first longitudinal axis. The first face plate is a semi-circular member opposed to the second face plate and the first set of guide rollers includes a first roller of the first set generally aligned with the first roller of said second set and a second roller of the first set generally aligned with the second roller of the second set. The sharpener further includes adjusting means for altering an angle at which the blade is sharpened. The adjustment means comprising a set of abrasive members including i) a first cylindrical abrasive member; ii) a second abrasive member tapering outwardly from an attachment end; and, iii) a third abrasive member tapering inwardly from an attachment end.

Another aspect of the invention is defined as an attachment for a power tool which has a body with securement means for receiving attachments to convert the power tool to a hand-held blade sharpener, the attachment comprising a) a set of abrasive members; b) a nose piece threadably attachable to the body, the nose piece having i) a first set of guide rollers affixed thereto at a first angle relative to the first longitudinal axis; ii) a second set of guide rollers mounted at a second different angle relative to the first longitudinal axis; whereby the first and second sets of guide rollers engage opposing faces of a blade to be sharpened. The set of abrasive members includes i) a first cylindrical abrasive member; ii) a second abrasive member tapering outwardly from an attachment end; and, iii) a third abrasive member tapering inwardly from an attachment end.

The second set of guide rollers is secured to a second face plate, the second face plate being mounted to the nose piece in a manner to permit limited pivotal movement relative to the first longitudinal axis making the hand-held blade sharpener self-adjusting. The second face plate is a semi-circular member and a first one of the second set of guide rollers is mounted on a first side of the first longitudinal axis and a second one of the second set of guide rollers is mounted on a second opposite side of the first longitudinal axis. The first face plate is a semi-circular member opposed to the second face plate and the first set of guide rollers includes a first roller of the first set generally aligned with said first roller of the second set and a second roller of the first set generally aligned with the second roller of the second set.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
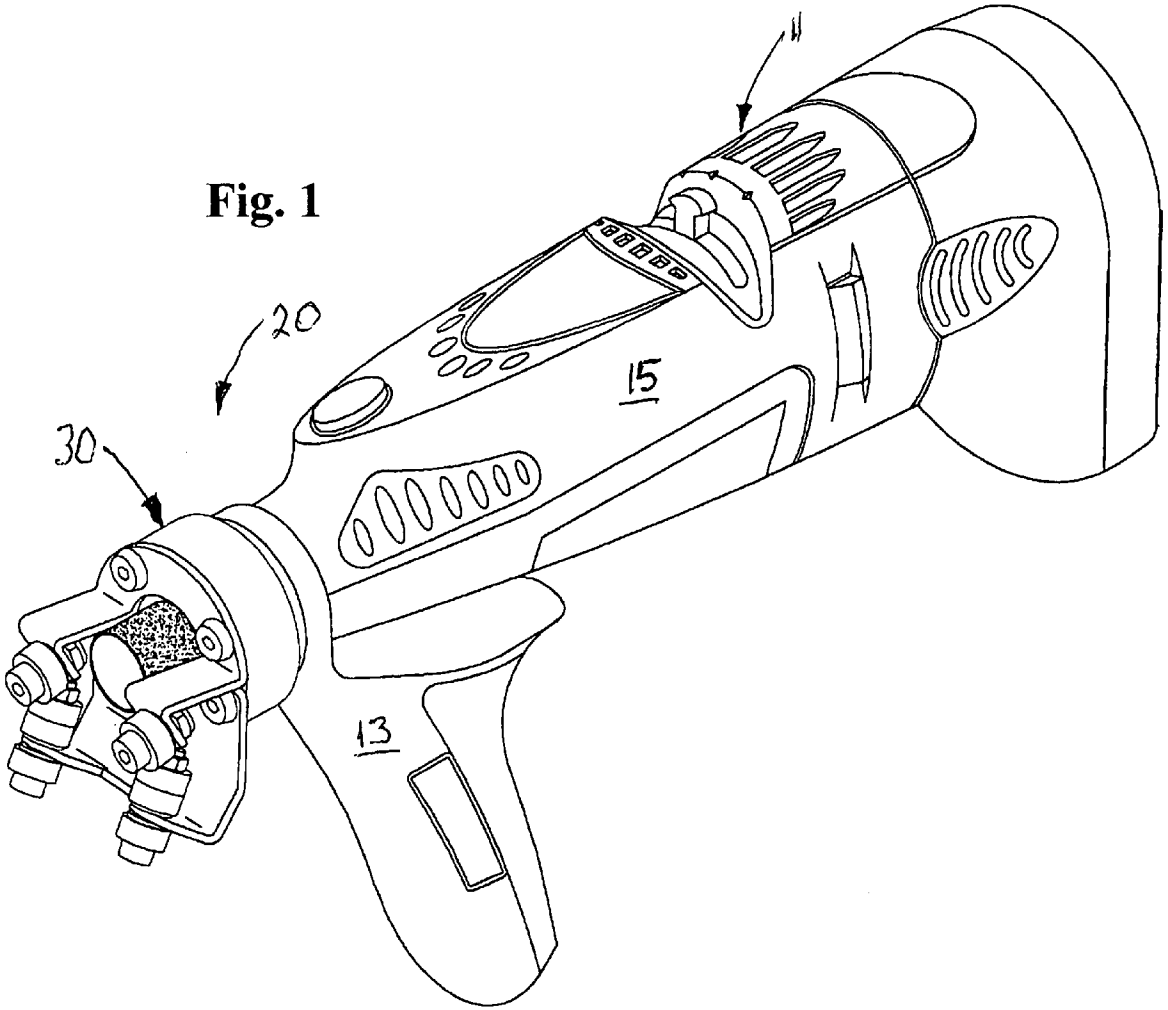
FIG. 1 is a front perspective view of a first embodiment of the blade sharpener of the present invention.
Figure 2:
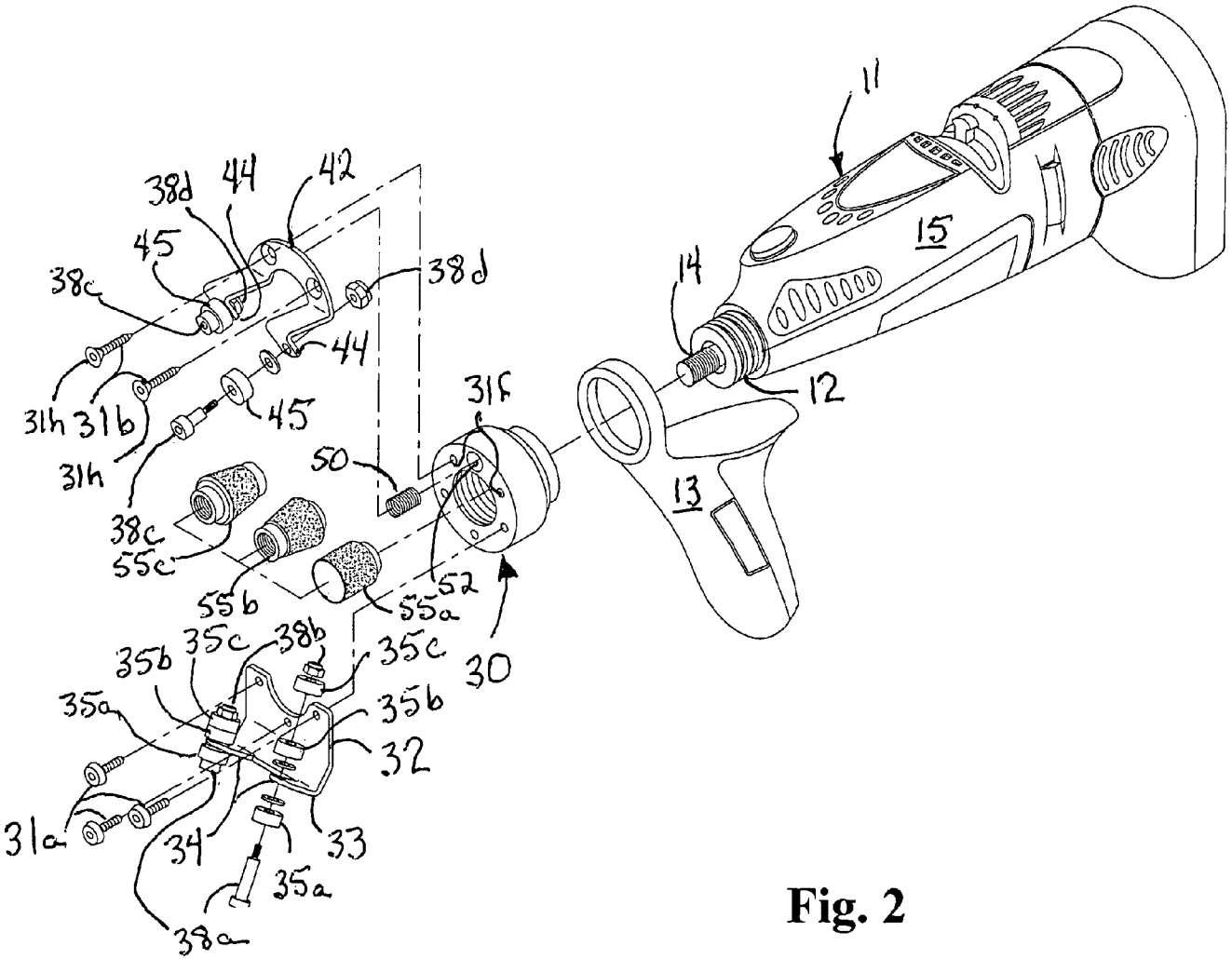
FIG. 2 is an exploded front perspective view of the first embodiment showing three types of grinding wheels used with the present invention.
Figure 3:
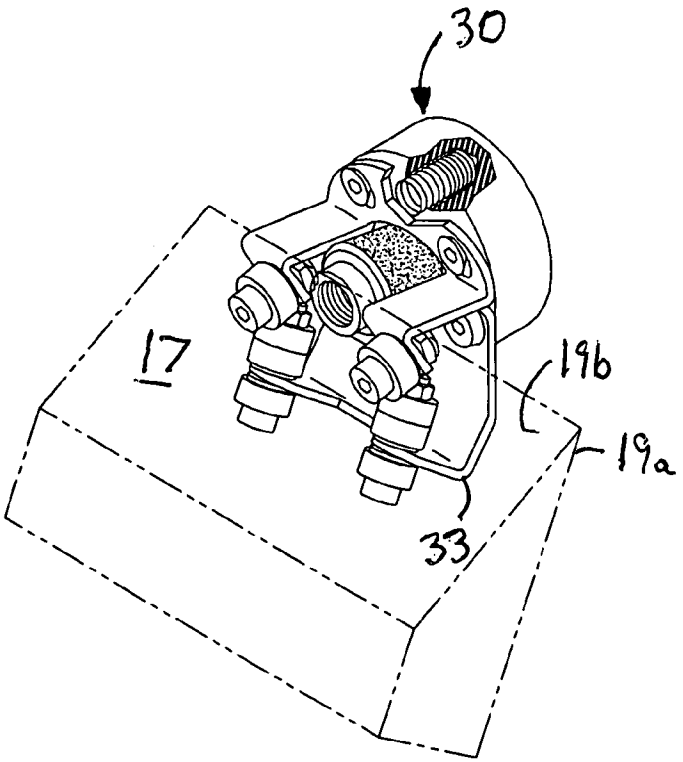
FIG. 3 is a side view depicting the first embodiment in use back-grinding a blade; and, FIG. 4 is a schematic depiction of the effects of back grinding vs. face grinding.

A first embodiment of the hand-held sharpener of the present invention is depicted in FIGS. 1-2 generally at 20. By way of example and not limitation, the rotary power tool 11 depicted in the drawing with which the features of the hand-held blade sharpener 20 of the present invention are implemented is a battery-powered Dremel 7700. Handle 13 is separate from the body 15 (FIG. 2) and, when nose piece 30 is threaded onto the front 12 of tool 11 through handle 13 capturing it there between, handle 13 can be rotated to any position through 360° relative to body 15 by loosening the attachment and rotating the handle or body, to facilitate sharpening of a blade 17 (FIG. 3).

Nose piece 30 has a first semi-circular face plate 32 mounted to a lower portion using screws 31*a*. First face plate 32 has a pair of arms 34 crooked at elbows 33, arms 34 mounting a first set of guide rollers, each of the arms 34 mounting a plurality (three shown) of guide rollers 35*a*, 35*b*, 35*c* which engage a front face 19*a* of blade 17 (FIG. 3). Arms 34 mount guide rollers 35*a*, 35*b*, 35*c* at a first angle $\alpha$ relative to center line A. Washers 37 separate rollers 35*b*, 35*c* from arm 34 allowing free rotation of rollers 35*b*, 35*c*. Stub axles 38*a* extend through rollers 35*a*, 35*b*, 35*c* and arm 34 each having a nut 38*b* threaded thereon. A second semi-circular face plate 42 is mounted on a portion of the front of nose piece 30 opposite to the first face plate 32 with screws 31*b*. Face plate 42 has a pair of arms 44 which mount single rollers 45 a on either side of the centerline A by means of stub axles 38*c* and nuts 38*d*. Arms 44 mount rollers 45 at a second different angle β relative to centerline A. The recesses 31*f* in nose piece 30 do not allow the screw heads 31*h* of screws 31*b* to snug against face plate 42. The stiff spring 50 (FIG. 3) extending from recess 52 in nose piece 30 tilt face plate outwardly therefrom shifting the angle β relative to centerline A. As guide rollers 35*a*, 35*b*, 35*c* and 45 engage opposite faces of blade 17, spring 50 allows the "jaw" to effectively be self-adjusting to accommodate blades of various thicknesses and cutting angles.

In lieu of the conventional chuck-style attachment, power tool 11 is preferably equipped with a threaded stud 14 as securement means for receiving/retaining attachments. As shown depicted in FIG. 2, three different style abrasive members 55*a*, 55*b*, 55*c* comprise a set of such attachments. Abrasive member 55*a* comprises a conventional cylindrical grinder, while member 55*b* is a tapered grinding wheel and member 55*c* has a reverse taper.

Figure 4:
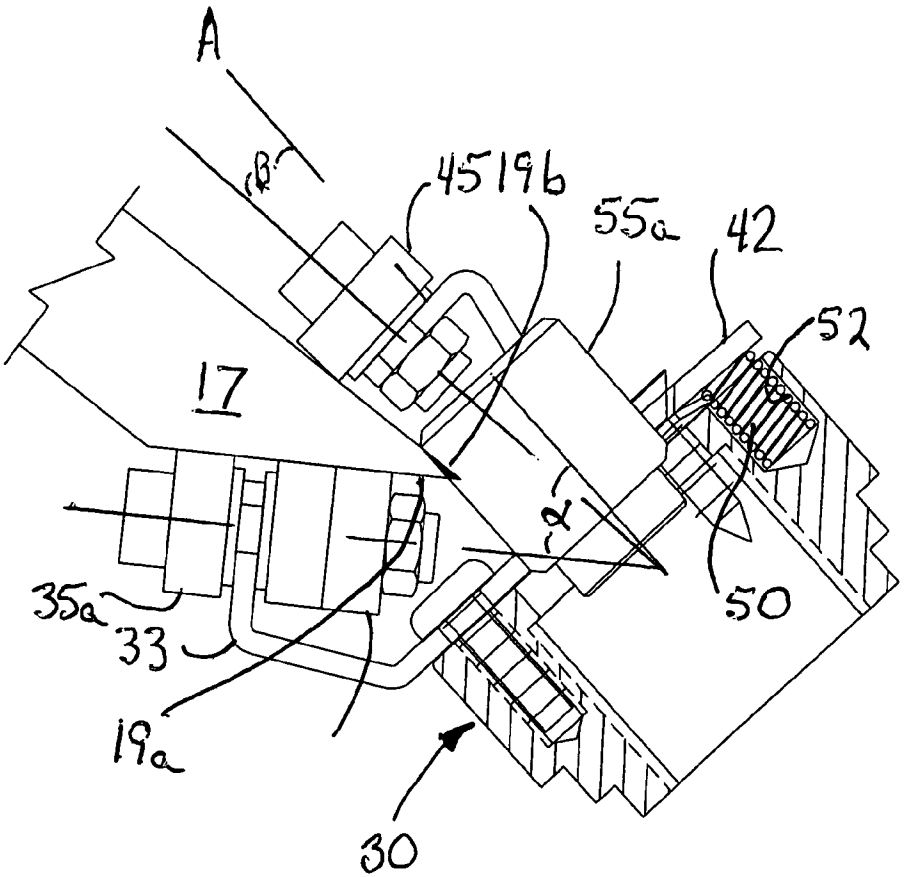

While hand-held sharpener 20 is capable of sharpening blade 17 by removing material from either surface, it is preferred that sharpener be utilized to back grind the blade 17, particularly where the blade 17 is utilized to feed material into/through the cutting mechanism, as in the case of a chipper or harvester. As seen in FIG. 4, if material is removed from the front face 19*a*, the angle between blade 17 and the material being fed is increased which, after a number of sharpenings, tends to reduce the biting/pulling power of the blade 17 shortening the useful life thereof and the machine in which it is mounted. By back grinding blade 17, i.e., removing material from the rear surface 19*b* of blade 17, the feed angle between the front face 19*a* and the material being fed into the harvester remains unchanged so as not to affect the biting/pulling power of blade 17.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A hand-held blade sharpener comprising:

a) a rotary power tool including
  i) a handle having an opening extending there through;
  ii) a body having securement means for receiving attachments said securement means defining a first longitudinal axis;

b) a nose piece threadably attachable to said body through said opening in said handle, said nose piece having
  i) a first set of guide rollers affixed thereto at a first angle relative to said first longitudinal axis;
  ii) a second set of guide rollers mounted at a second different angle relative to said first longitudinal axis;

whereby said first and said second sets of guide rollers engage opposing faces of a blade to be sharpened on either side of a grinder of the rotary power tool.

2. The hand-held blade sharpener of claim 1 wherein said second set of guide rollers is secured to a second face plate, said second face plate being mounted to said nose piece in a manner to permit limited pivotal movement relative to said first longitudinal axis making said hand-held blade sharpener self-adjusting.

3. The hand-held blade sharpener of claim 2 wherein said second face plate is a semi-circular member and a first one of said second set of guide rollers is mounted on a first side of said first longitudinal axis and a second one of said second set of guide rollers is mounted on a second opposite side of said first longitudinal axis.

4. The hand-held blade sharpener of claim 3 wherein said first face plate is a semi-circular member opposed to said second face plate and said first set of guide rollers includes a first roller of said first set generally aligned with said first roller of said second set and a second roller of said first set generally aligned with said second roller of said second set.

5. The hand-held blade sharpener of claim 4 further comprising adjusting means for altering an angle at which the blade is sharpened.

6. The hand-held blade sharpener of claim 5 wherein said adjustment means comprising a set of abrasive members including
  i) a first cylindrical abrasive member;
  ii) a second abrasive member tapering outwardly from an attachment end; and,
  iii) a third abrasive member tapering inwardly from an attachment end.

7. An attachment for a power tool which has a body with a securement means for receiving attachments to convert said power tool to a hand-held blade sharpener, said attachment comprising a) a set of abrasive members;

b) a nose piece threadably attachable to said body, said nose piece having
  i) a first set of guide rollers affixed thereto at a first angle relative to said first longitudinal axis;
  ii) a second set of guide rollers mounted at a second different angle relative to said first longitudinal axis;

whereby said first and said second sets of guide rollers engage opposing faces of a blade to be sharpened.

8. The attachment of claim 7 wherein said set of abrasive members comprises
  i) a first cylindrical abrasive member;
  ii) a second abrasive member tapering outwardly from an attachment end; and,
  iii) a third abrasive member tapering inwardly from an attachment end.

9. The attachment of claim 7 wherein said second set of guide rollers is secured to a second face plate, said second face plate being mounted to said nose piece in a manner to permit limited pivotal movement relative to said first longitudinal axis making said hand-held blade sharpener self-adjusting.

10. The attachment of claim 9 wherein said second face plate is a semi-circular member and a first one of said second set of guide rollers is mounted on a first side of said first longitudinal axis and a second one of said second set of guide rollers is mounted on a second opposite side of said first longitudinal axis.

11. The attachment of claim 10 wherein said first face plate is a semi-circular member opposed to said second face plate and said first set of guide rollers includes a first roller of said first set generally aligned with said first roller of said second set and a second roller of said first set generally aligned with said second roller of said second set.

* * * * *